US009324307B1

(12) United States Patent
Castillo et al.

(10) Patent No.: US 9,324,307 B1
(45) Date of Patent: Apr. 26, 2016

(54) INSTRUMENT COVER SYSTEM FOR CUSTOMIZING APPEARANCE

(71) Applicants: Alexander A. Castillo, New York, NY (US); Joel Murphy, Brooklyn, NY (US)

(72) Inventors: Alexander A. Castillo, New York, NY (US); Joel Murphy, Brooklyn, NY (US)

( * ) Notice: Subject to any disclaimer, the term of this patent is extended or adjusted under 35 U.S.C. 154(b) by 0 days.

(21) Appl. No.: 14/796,624

(22) Filed: Jul. 10, 2015

Related U.S. Application Data

(63) Continuation-in-part of application No. 14/266,646, filed on Apr. 30, 2014, now abandoned, and a continuation-in-part of application No. 13/227,892, filed on Sep. 8, 2011, now abandoned.

(51) Int. Cl.
*G10D 1/08* (2006.01)

(52) U.S. Cl.
CPC ..... *G10D 1/08* (2013.01)

(58) Field of Classification Search
CPC ..... G10D 1/08
See application file for complete search history.

(56) References Cited

U.S. PATENT DOCUMENTS 4,236,191 A * 11/1980 Martinez ..... G02B 6/0005 362/554
4,563,933 A * 1/1986 Kim ..... G10D 3/00 84/267
4,815,355 A 3/1989 Cavaness
4,890,529 A * 1/1990 Grant ..... G10D 3/00 362/263
5,796,025 A * 8/1998 Haake ..... G10H 3/18 84/464 A
5,922,981 A * 7/1999 Ballister ..... A63J 17/00 84/464 A
5,930,026 A 7/1999 Jacobson et al.
D504,906 S 5/2005 Katsumata
7,064,259 B1 * 6/2006 Kelly ..... G10H 1/0016 84/464 A
7,465,870 B1 12/2008 Homan
7,504,578 B2 * 3/2009 Lewry ..... G10H 1/32 84/290
8,144,129 B2 3/2012 Hotelling et al.
8,385,980 B2 2/2013 Causey et al.
8,697,977 B1 * 4/2014 Lysaght ..... G10H 1/0016 84/464 A
8,797,255 B2 8/2014 Hsu et al.
2006/0278062 A1 12/2006 Cook
2008/0074383 A1 3/2008 Dean
2012/0084123 A1 4/2012 Pajic
2015/0206515 A1 * 7/2015 Waugh ..... G06F 3/0412 345/173

* cited by examiner

*Primary Examiner* — Robert W Horn

(57) ABSTRACT

An instrument cover system for displaying dynamic or static images. A display coating having electronic ink is disposed on a front surface of a guitar body. The display coating is operatively connected to a display processor, which is operatively connected a display memory component adapted to store instructions that causes the processor to perform operations for displaying an image. A first control button is operatively connected to the display processor and functions to change the image on display. A connector component is operatively connected to the display processor and functions to allow the system to connect to a power source or a separate electronic device. The electronic device has a device memory for storing instructions that causes a device processor to perform operations for changing and displaying an image.

12 Claims, 10 Drawing Sheets

(In-use View)

(Front View)

(Back View)

(In-use View)

INSTRUMENT COVER SYSTEM FOR CUSTOMIZING APPEARANCE

CROSS REFERENCE

This application is a continuation-in-part and claims the benefit of U.S. patent application Ser. No. 14/266,646 filed on Apr. 30, 2014, which is a continuation-in-part and claims the benefit of U.S. non-provisional application Ser. No. 13/227,892 filed Sep. 8, 2011, the specification(s) of which is(are) incorporated herein by reference in its entirety.

FIELD OF THE INVENTION

The present invention is directed to a system that allows a user to customize the appearance of his/her instrument, more particularly to a cover system for an instrument featuring electronic ink.

BACKGROUND OF THE INVENTION

Some individuals wish to have multiple different instruments (e.g., guitars) for aesthetic purposes. The present invention features an instrument cover system featuring static or dynamic images, which allow a user to change the appearance of his/her instrument. In some embodiments, the system is configured to be compatible with a smart phone application. The system of the present invention allows the instrument to be customized.

Electronic ink is a technology known in the art, wherein microcapsules filled with pigmented ink can be caused to change color when a charge is applied, as described in U.S. Pat. No. 5,930,026. This technology can be used to create electronic displays such as that described in U.S. Pat. No. 8,797,255. In these displays, the electronic ink is divided into cells that act as pixels that can be controlled by applying appropriate electronic signals. Multi-colored electronic ink displays can be created by combining pigments of different colors in interleaved proximity. This present invention utilizes an electronic ink display on the surface of an instrument to project images onto the instrument surface.

SUMMARY

The present invention features an instrument cover system that allows for allows a user to change the appearance of his/her instrument. In some embodiments, the system comprises a guitar with a body, a display comprising electronic ink and disposed on at least a portion of the guitar body for projecting dynamic or static images, a display processor operatively connected to the display, a display memory operatively connected to the display microprocessor and adapted to store images and computer-readable instructions that, when executed by the display processor, cause the display processor to perform operations for displaying images, a first control button operatively connected to the display processor, a power supply for supplying power to the system, a separate electronic device that sends signals to the display processor to display images, and a connector component that connects the system to a power source or another electronic device.

In some embodiments, the memory comprises flash memory, random access memory (RAM), read-only memory (ROM), electrically erasable programmable read-only memory (EEPROM), or a combination thereof. In other embodiments, the connector component is a universal serial bus (USB) port. In still other embodiments, the system is compatible with a mobile device such as a smart phone or tablet.

In some embodiments, the system further comprises a microphone system disposed on the guitar body. When the microphone system detects a note, the microphone system sends a signal to the display processor, which then identifies the note and determines the image corresponding to the note for display.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
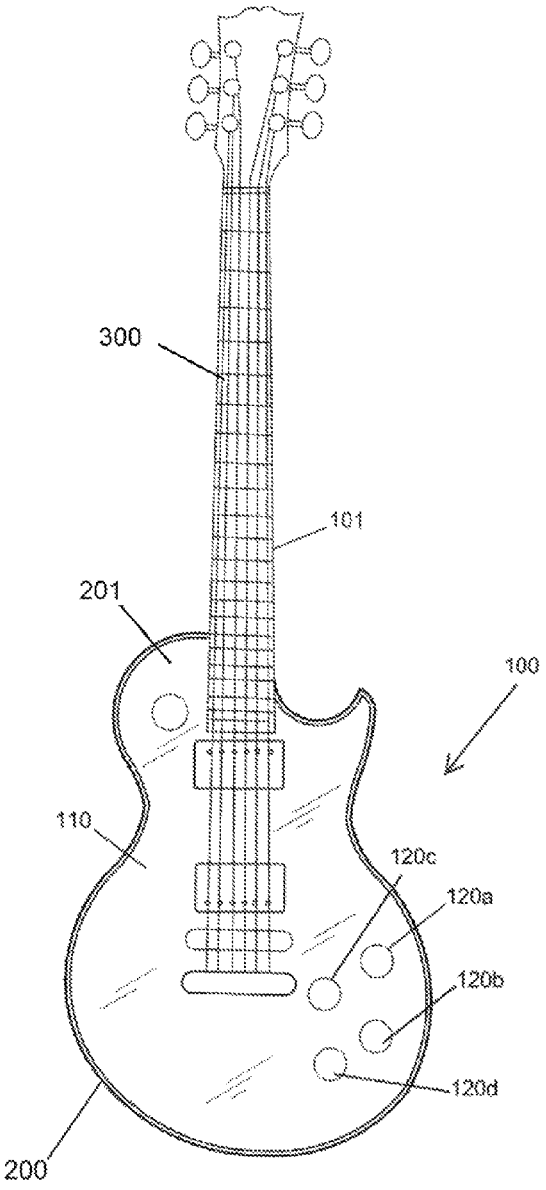
FIG. 1 is a front view of the system of the present invention.
Figure 2:
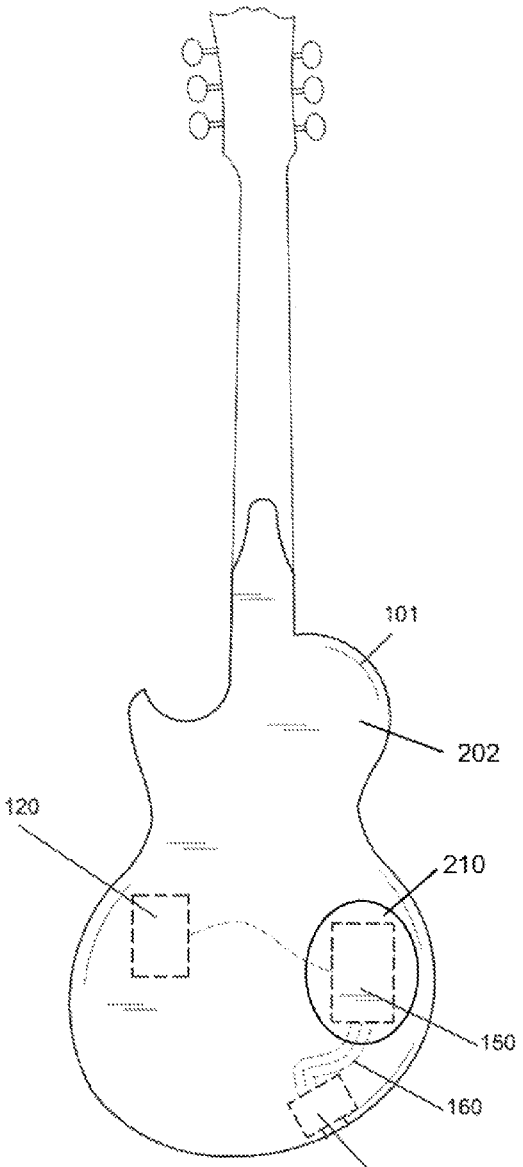
FIG. 2 is a back view of the system of the present invention.
Figure 3:
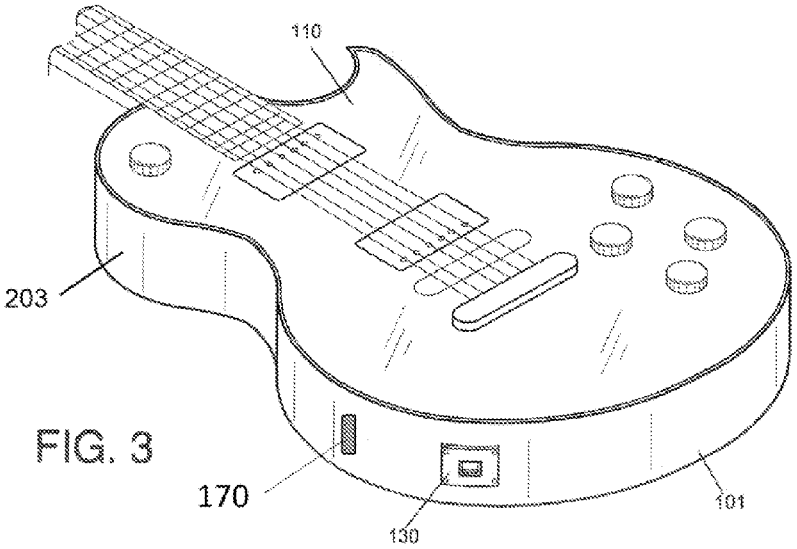
FIG. 3 is a perspective view of the system of the present invention.

Following is a list of elements corresponding to a particular element referred to herein:

100 instrument cover system
101 guitar
110 electronic ink display
111 electronic ink display connector
120 control buttons
**120*a*** first control button
**120*b*** second control button
**120*c*** third control button
**120*d*** fourth control button
130 connector component
150 display processor
158 display memory
160 connecting wiring
170 microphone system
200 guitar body
201 front surface
202 back surface
203 side surface

205 front slot
210 compartment
300 guitar neck
400 electronic device Referring now to FIG. 1-13, the present invention features an instrument cover system (100) comprising a guitar (101), a flexible electronic ink display (110), a display processor (150) disposed inside the compartment (210), a display memory (158), a first control button (120*a*), a power supply, a separate electronic device (400), and a connector component (130) disposed on a side surface (203) of the guitar body (200). The system (100) allows a user to change the appearance of his/her instrument.

In some embodiments, the guitar (101) comprises a guitar body (200) and a guitar neck (300). The guitar body (200) may have a front surface, a back surface (202), at least one front slot disposed through the front surface (201). At least one compartment (210) may be disposed inside the guitar body (200) and can be accessible through the back surface (202). In other embodiments, the flexible electronic ink display (110) is disposed on at least a portion of the front surface (201) of the guitar body (200). In alternate embodiments, the electronic ink display (110) may be disposed on at least a portion of the back surface (202), side surface (203), or the guitar neck (300).

In some embodiments, the electronic ink display (110) may comprise an electronic ink layer divided into a plurality of pixels arranged in a grid, an electrode layer, disposed beneath the electronic ink layer and comprising a plurality of electrodes operatively connected to the pixels of the electronic ink layer, a flexible backplane disposed beneath the electrode layer and comprising flexible electrical circuitry operatively connected to the electrodes of the electrical layer and to an input connector (111), two moisture barrier layers disposed above and below the electronic ink layer and the backplane such that the electronic ink layer and the backplane are positioned in between the two moisture barrier layers, two laminate layers disposed above and below the moisture barrier layers such that the moisture barrier layers are positioned in between the two laminate layers, and the input connector (111) comprising a plurality of electrical leads operatively connected to the plurality of pixels of the electrode layer.

In some embodiments, the display processor (150) may be operatively connected to the connector (111) of the electronic ink display (110). The display processor (150) can generate a first plurality of electrical signals corresponding to each pixel for displaying an image on the electronic ink display (110). In other embodiments, the display memory (158) may be operatively coupled to the display processor (150). The display memory (158) may comprise flash memory, random access memory (RAM), read-only memory (ROM), electrically erasable programmable read-only memory (EEPROM), or a combination thereof. In preferred embodiments, the display memory (158) may be configured to store a plurality of images and to store computer-readable instructions that, when executed by the display processor, cause the display processor to perform operations. These operations may comprise retrieving a dynamic or static image from the display memory (158), and generating a second plurality of signals configured to cause the electronic ink display to display the image at the plurality of electrical inputs of the connector of the electronic ink display.

In some embodiments, the first control button (120*a*) may be operatively connected to the display processor (150). The first control button (120*a*) can be configured to send a first electronic signal to the display processor. Upon receiving the first electronic signal, the display processor can load an image and display it on the electronic ink display. The first control button (120*a*) can be disposed on the front surface (201) or side surface (203) of the guitar body (200).

In alternative embodiments, the system (100) may further comprise control buttons (120) that allow the user to switch between various display images. For example, in some embodiments, a second control button (120*b*) (e.g., knob) is disposed on the display (110). The second control button (120*b*) can be operatively connected to the display processor and configured to send a third electronic signal to the display processor that changes the image displayed on the electronic ink display. In other embodiments, a third control button (120*c*) (e.g., knob) is disposed on the display (110). In still other embodiments, a fourth control button (120*d*) (e.g., knob) is disposed on the display (110).

In other embodiments, the power supply can be configured to supply a direct current (DC) voltage and current. The power supply may be operatively connected to the electronic ink display, the display processor, and the memory. Exemplary embodiments of power supplies include a battery, an adapter connected to the power supply of the guitar, or an external power supply.

In still other embodiments, the connector component (130) may be operatively connected to the display processor (150), e.g., via wiring. Furthermore, the connector component (130) may operatively connect the system (100) to the power supply or the electronic device. In some embodiments, the connector component (130) may be a universal serial bus (USB) port or a high-definition multimedia interface (HDMI) port. For example, the connector component (130) can allow for connection to a power source or another electronic device (e.g., a USB port compatible device). The connector component (130) may allow for downloading and/or modifying the display memory (158). For instance, a user may download a new display program onto the display memory (158) so as to be displayed on the display (110). Such connector components and means of downloading and/or modifying memory components are well known to one of ordinary skill in the art.

In some embodiments, the separate electronic device (400) can transmit a second electronic signal to the display processor (150). The electronic device may comprise a device processor operatively connected to the electronic device, a touchscreen display, and a device memory operatively coupled to the device processor. The device memory can store computer-readable instructions that, when executed by the device processor, cause the device processor to perform operations. These operations may include displaying a user interface comprising an input control on the touchscreen display that a user uses to select an image with the input control, receiving a dynamic or static image selection from the user input on the touchscreen display, and transmitting the second electronic signal of the dynamic or static image selection to the display processor (150). Exemplary embodiments of input controls include a dial, buttons, or a scroll slide.

The figures illustrate a guitar (101) as an example; however, the present invention is not limited to use with a guitar (101) and may be used with other instruments such as a drum or piano. In preferred embodiments, the system (100) is configured to be compatible with a smart phone application. The system (100) may feature static images or dynamic images, e.g., images in motion.

In some embodiments, the electronic ink display (110) may be shaped to match the face of the instrument, however the display (110) may alternatively cover the whole body of the instrument or a portion thereof. In other embodiments, the display (110) covers all or just a portion of the face of the instrument. As shown in FIG. 1, the display (110) provides room for the features of the instrument, for example, the sound hole, saddle, bridge, etc.

In other embodiments, the system may further comprise a wireless transceiver operatively connected to the display processor. The wireless transceiver may be configured to receive a fifth electronic signal from a wireless device, and to send a sixth electronic signal to the display processor. Upon receiving the sixth electronic signal, the display processor is configured to load a new image from the display memory and display the new image on the electronic ink display. Preferably, any signal as described herein is configured to specify a specific image.

In some embodiments, the system (100) further comprises a microphone system (170) disposed on the guitar body (200). The microphone system (170) may be operatively connected to the display microprocessor (150). In other embodiments, the display memory is further configured to store computer-readable instructions that, when executed by the display processor, cause the display processor to perform microphone-related operations. These operations can include receiving a fourth electronic signal from the microphone system (170), processing the fourth electronic signal to determine a note, retrieving an image from the display memory corresponding to the note, and generating a third plurality of signals that comprise the image at each electrical input of the connector of the electronic ink display.

In alternate embodiments, the microphone system (170) is configured to detect sound and determine the frequency (note), which is then relayed to the display microprocessor (150) for determining the image that is to be displayed on the display (110). Thus, in some embodiments, the image displayed on the display (110) can change based on the note or frequency that is detected by the microphone system (170). A user can select from various programs, for example a program that displays a color when a particular note is played in tune, e.g., for tuning purposes (e.g., when the note is played in tune, Color 1 is displayed, and if the note is out of tune, Color 2 is displayed). Or, the user can select a program designed to display dynamic images when the microphone system detects various notes (e.g., C=display 1, Db/C#=display 2, D=display 3, Eb/D#=display 4, E=display 5, F=display 6, Gb/F#=display 7, G=display 8, Ab/G#=display 9, A=display 10, Bb/A#=display 11, B=display 12, etc., depending on the octave). Microphones and systems for detecting frequencies are well known to one of ordinary skill in the art.

Figure 4:
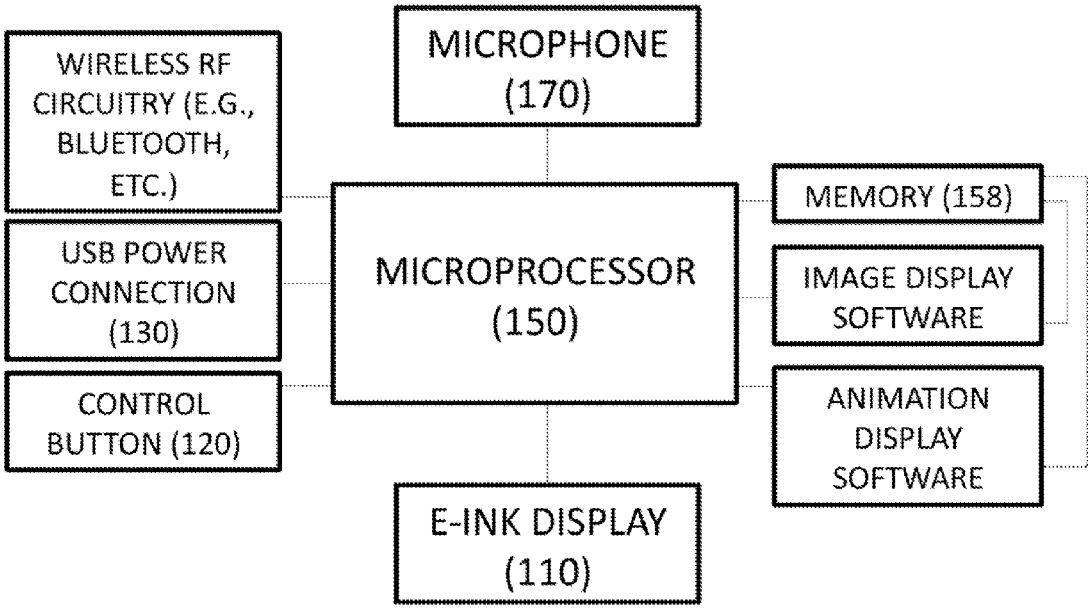
FIG. 4 is a schematic representation of the electrical components of the system of the present invention.

As shown in FIG. 4, in some embodiments, the microprocessor (150) is operatively connected to a wireless system that allows for connection to a wireless RF circuitry (e.g., Bluetooth®, etc.).

In some embodiments, the separate electronic device may be a mobile device such as a smart phone or tablet. The mobile device can change the image remotely or by directly connecting the mobile device to the guitar via the connector component. In some embodiments, the guitar has a receiver for receiving the signals remotely from the mobile device. In other embodiments, the mobile device has an application wherein a user can browse through various static and dynamic images. When a user finds a desired image, the user selects the image and the mobile device sends signals to the display microprocessor to display the desired image on the body.

Figure 5:
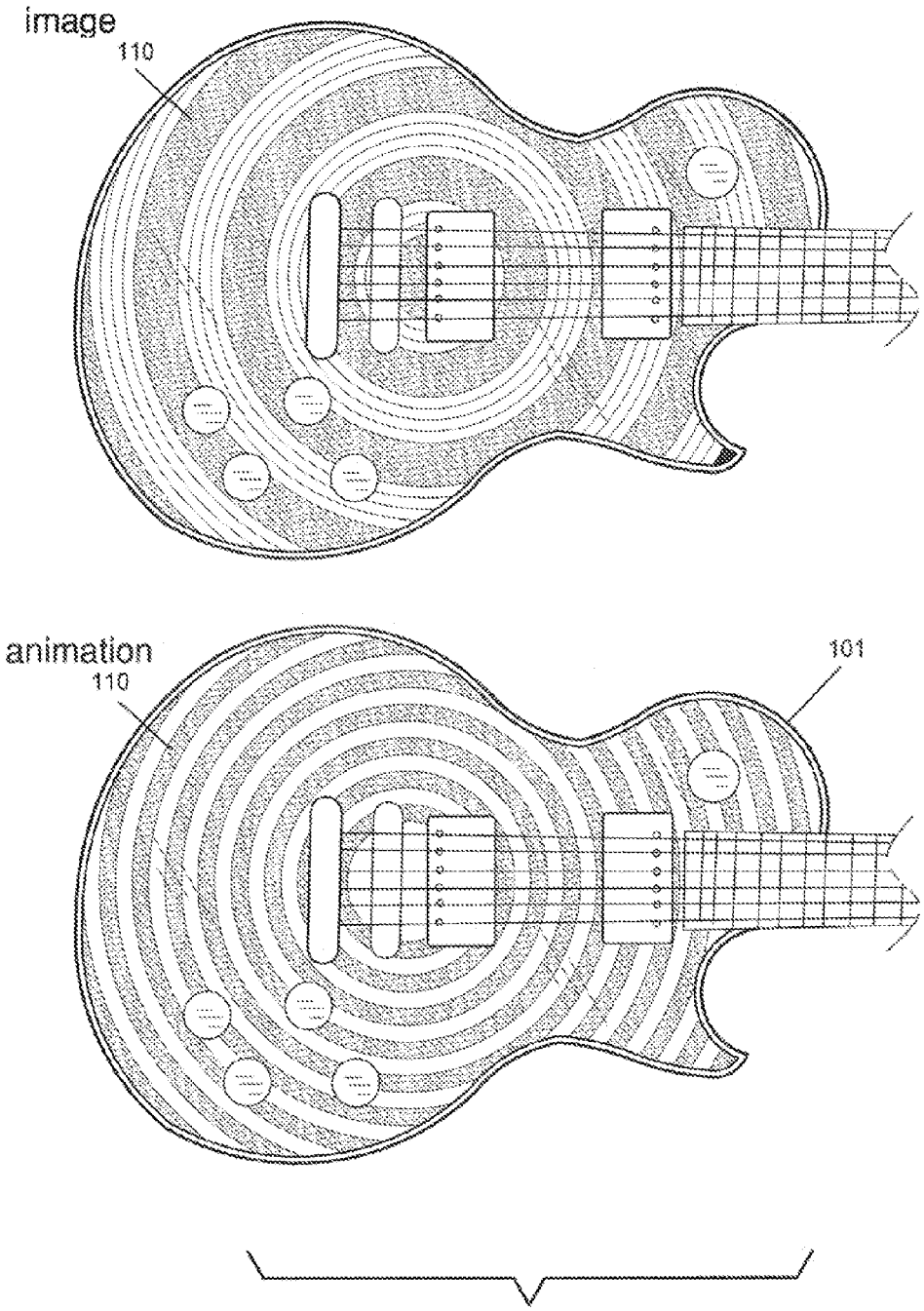
FIG. 5 shows two in-use views of the system of the present invention.
Figure 6:
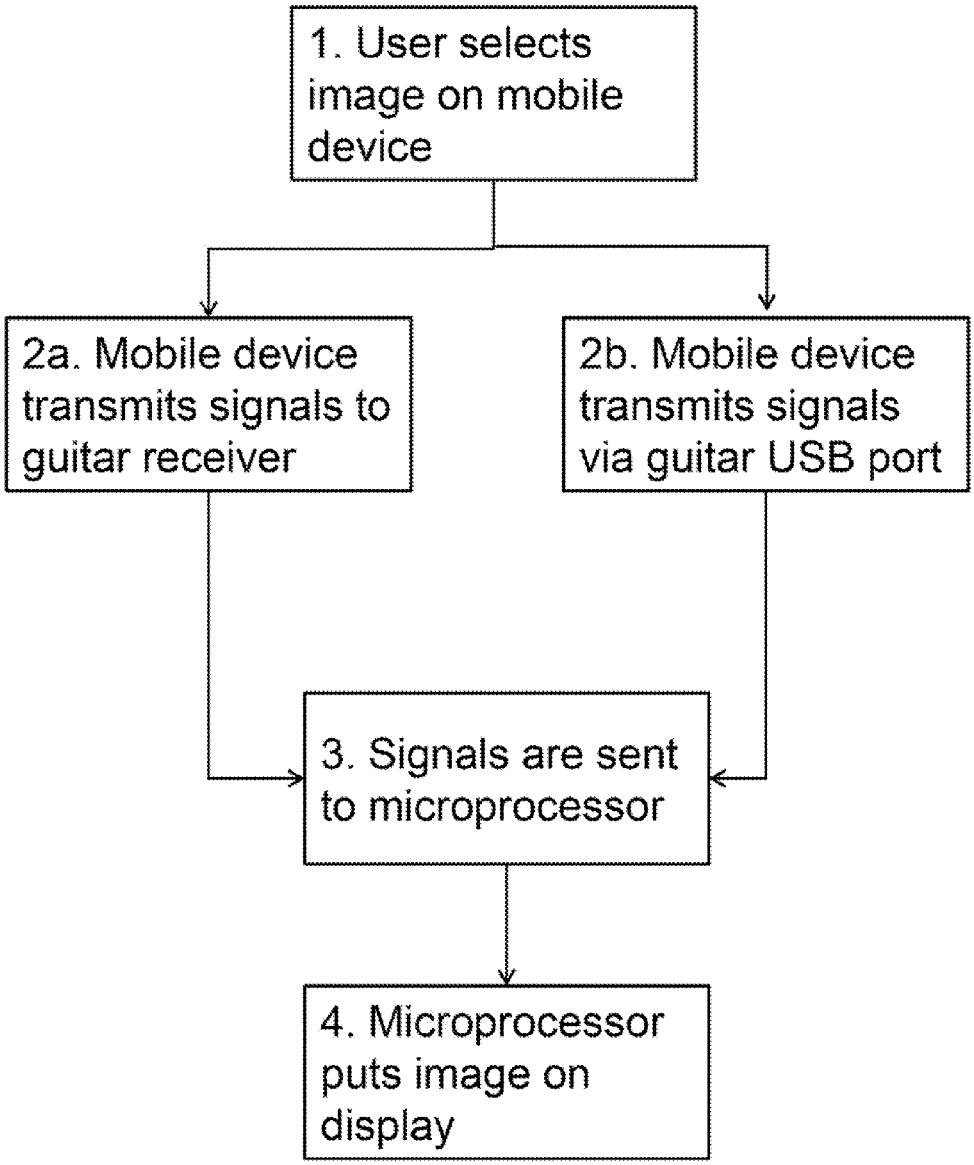
FIG. 6 shows a block diagram of the system when utilizing a mobile device to change images on display.
Figure 7:
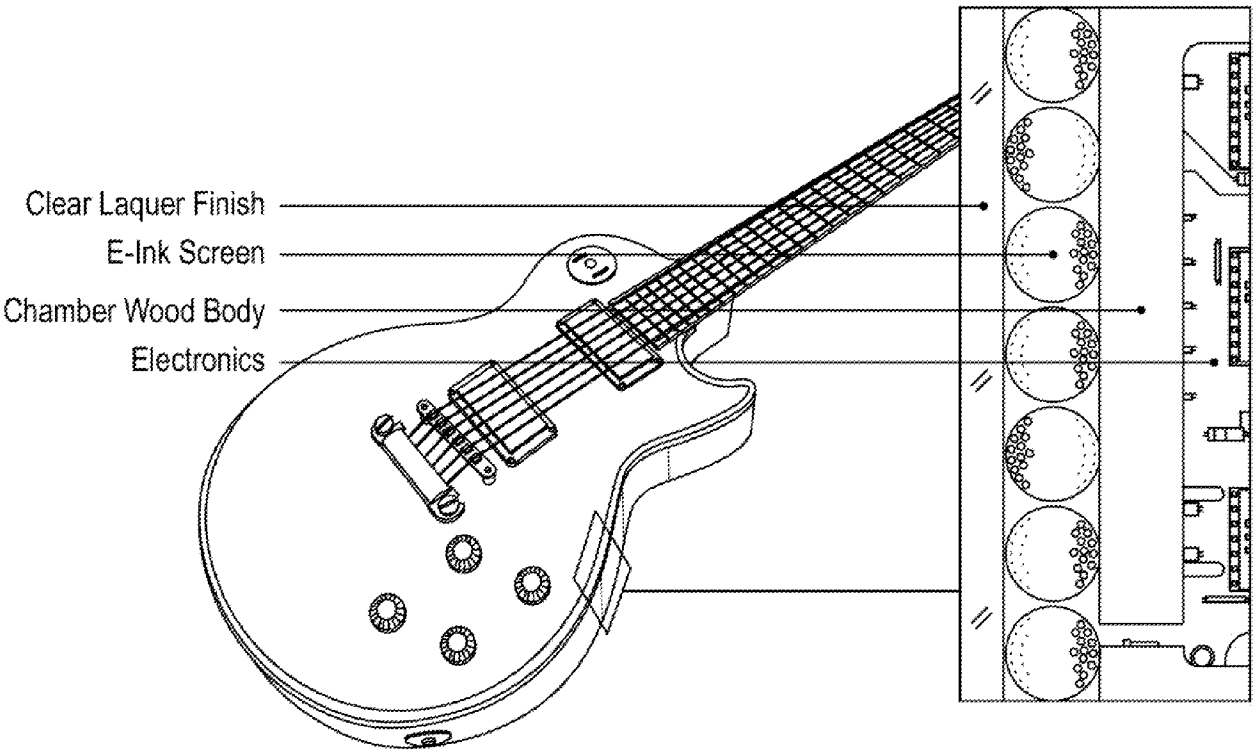
FIG. 7 shows a cross-sectional view of the display coating on the guitar body.
Figure 8:
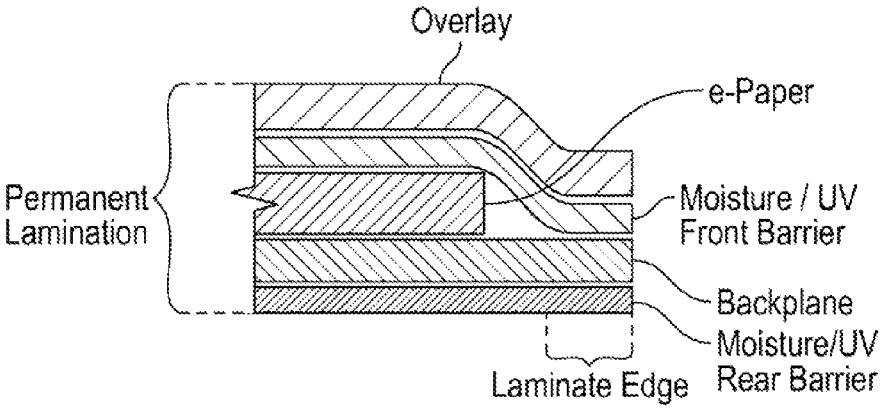
FIG. 8 shows a cross-sectional view of the display coating.
Figure 9:
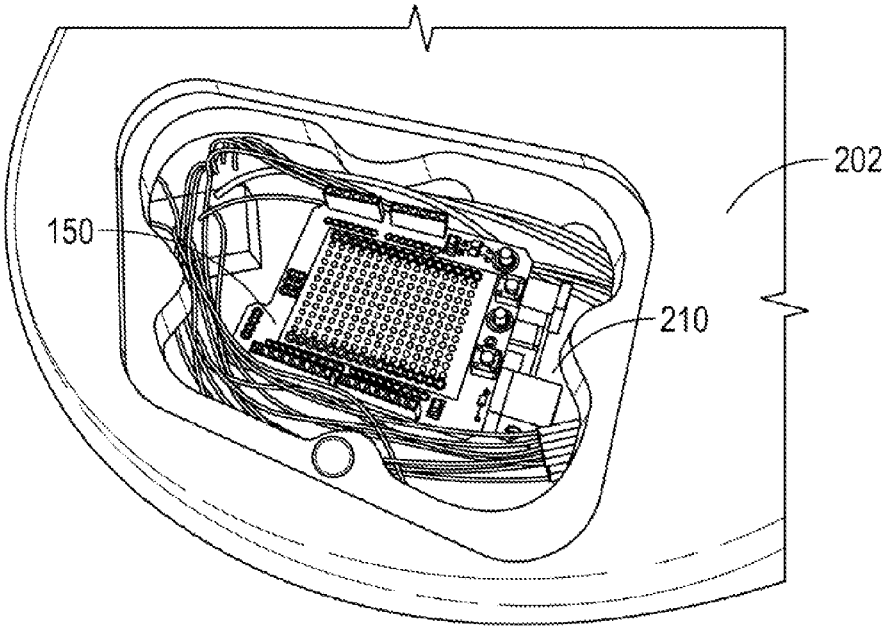
FIG. 9 shows a compartment on the back surface of the guitar body.
Figure 10:
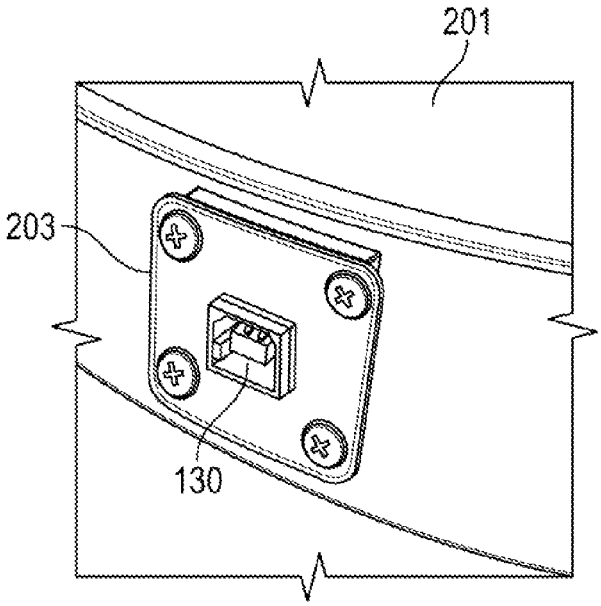
FIG. 10 shows an exemplary connector component on the side surface of the guitar body.
Figure 11:
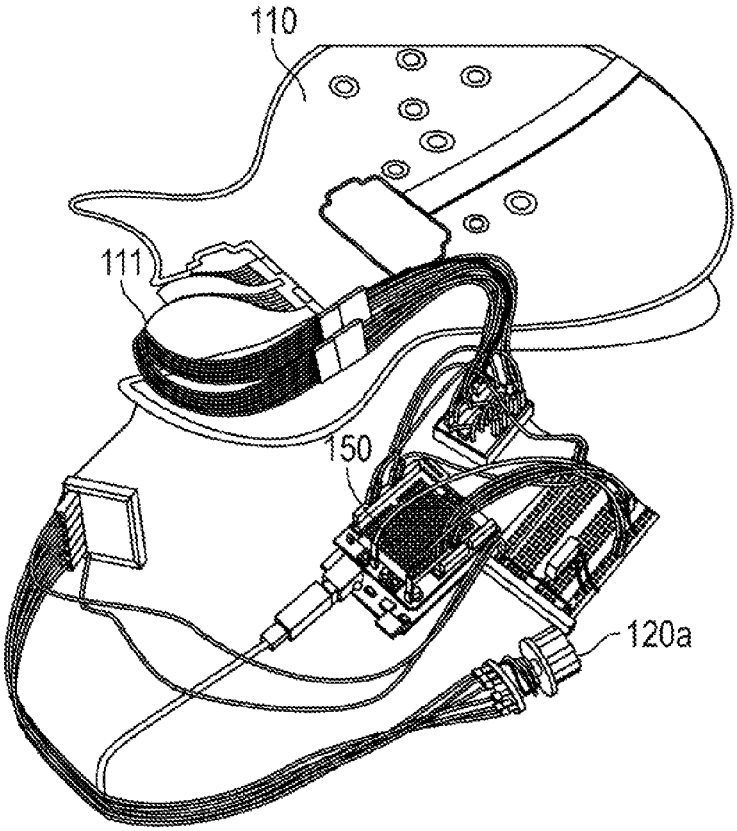
FIG. 11 shows an exemplary display coating and display processor.
Figure 12:
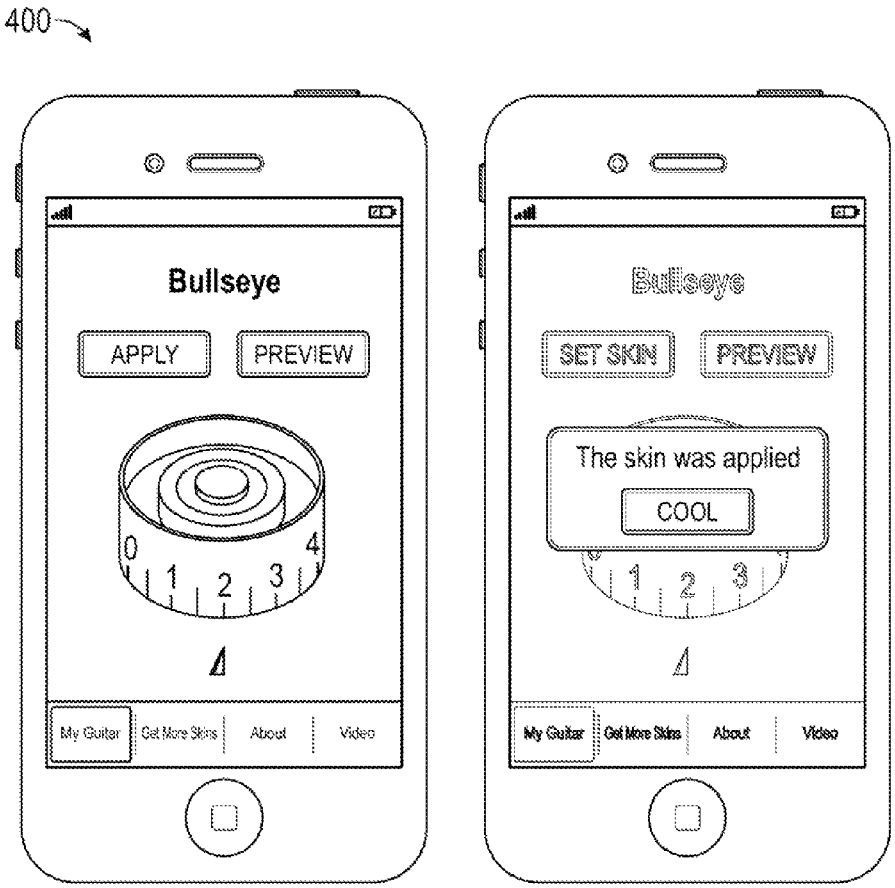
FIG. 12 shows an exemplary embodiment of an electronic device for changing images on display.
Figure 13:
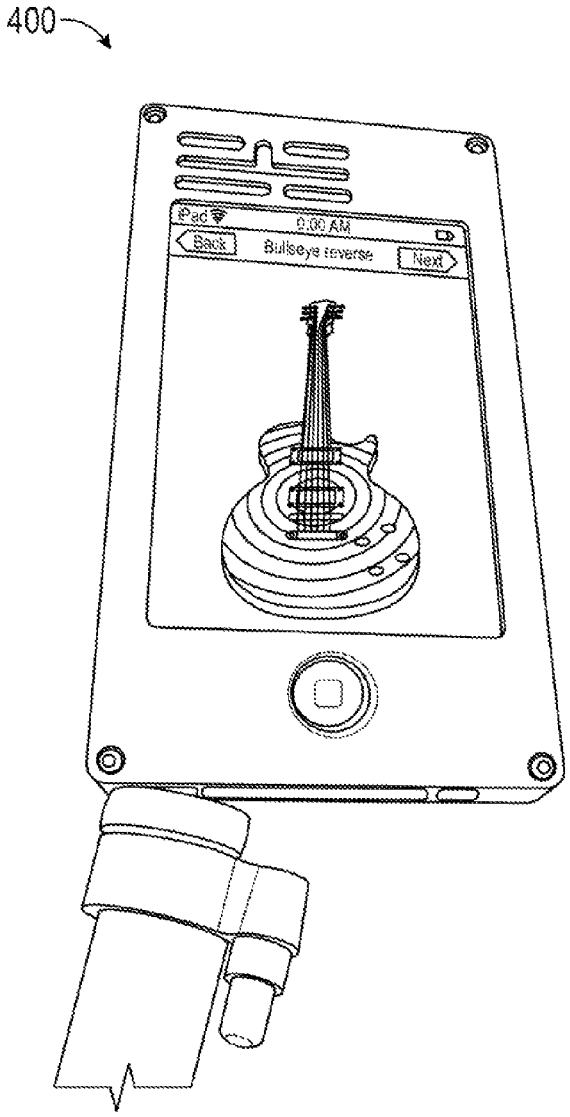
FIG. 13 shows an exemplary embodiment of an electronic device for changing images on display.

FIG. 5 shows two examples of patterns displayed on the display (110) (e.g., a static image, a dynamic or animated image). The system (100) can display any appropriate pattern, static or dynamic. The present invention is not limited to the patterns shown in FIG. 5.

The disclosures of the following U.S. Patents are incorporated in their entirety by reference herein: U.S. Pat. No. 4,563,933; U.S. Pat. No. 4,815,355; U.S. Pat. No. 4,890,529; U.S. Pat. No. 5,796,025; U.S. Design Pat. No. D504906; U.S. Pat. No. 7,465,870; U.S. Pat. No. 7,504,578.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures.

The reference numbers recited in the below claims are solely for ease of examination of this patent application, and are exemplary, and are not intended in any way to limit the scope of the claims to the particular features having the corresponding reference numbers in the drawings.

What is claimed is:

1. An instrument cover system (100) comprising:

a. a guitar (101) having a guitar body (200) and a guitar neck (300), the guitar body (200) having a front surface (201) and a back surface (202), wherein at least one front slot is disposed through the front surface (201), wherein at least one compartment (210) is disposed in the guitar body (200), wherein the compartment (210) is accessible through the back surface (202);

b. a flexible electronic ink display (110) disposed on at least a portion of the front surface (201) of the guitar body (200), wherein the display comprises:

i. an electronic ink layer, divided into a plurality of pixels arranged in a grid;

ii. an electrode layer, disposed beneath the electronic ink layer, comprising a plurality of electrodes operatively connected to the pixels of the electronic ink layer;

iii. a flexible backplane, disposed beneath the electrode layer, comprising flexible electrical circuitry operatively connected to the electrodes of the electrical layer and to an input connector (111);

iv. two moisture barrier layers, disposed above and below the electronic ink layer and the backplane such that the electronic ink layer and the backplane are positioned in between the two moisture barrier layers;

v. two laminate layers disposed above and below the moisture barrier layers such that the moisture barrier layers are positioned in between the two laminate layers; and vi. the input connector (111) comprising a plurality of electrical leads operatively connected to the plurality of pixels of the electrode layer;

c. a display processor (150) operatively connected to the connector (111) of the electronic ink display (110), wherein the display processor (150) is disposed inside the compartment (210), wherein the display processor (150) generates a first plurality of electrical signals corresponding to each pixel for displaying an image on the electronic ink display (110);

d. a display memory (158) operatively coupled to the display processor (150), wherein the display memory (158)

is configured to store a plurality of images and to store computer-readable instructions that, when executed by the display processor, cause the display processor to perform operations comprising:

i. retrieving a dynamic or static image from the display memory (158); and ii. generating a second plurality of electrical signals configured to cause the electronic ink display to display the image, at the plurality of electrical inputs of the connector of the electronic ink display;

e. a first control button (120*a*) operatively connected to the display processor (150), wherein the first control button (120*a*) is configured to send a first electronic signal to the display processor, wherein upon receiving the first electronic signal, the display processor loads an image and displays it on the electronic ink display;

f. a power supply configured to supply a direct current (DC) voltage and current, wherein the power supply is operatively connected to the electronic ink display, the display processor, and the memory;

g. a separate electronic device (400) for transmitting a second electronic signal to the display processor (150), wherein the electronic device comprises:

i. a device processor operatively connected to the electronic device;

ii. a touchscreen display;

iii. a device memory operatively coupled to the device processor, the device memory stores computer-readable instructions that, when executed by the device processor, cause the device processor to perform operations comprising:

1. displaying a user interface on the touchscreen display, wherein the user interface comprises an input control, wherein a user uses the touchscreen to select an image with the input control;

2. receiving a dynamic or static image selection from the user input on the touchscreen display; and 3. transmitting the second electronic signal of the dynamic or static image selection to the display processor (150); and h. a connector component (130) disposed on a side surface (203) of the guitar body (200), wherein the connector component (130) is operatively connected to the display processor (150), the connector component (130) operatively connects the system (100) to the power supply or the electronic device.

2. The system of claim 1, wherein the input control comprises a dial, buttons, or a scroll slide.

3. The system of claim 1, wherein the power supply is a battery, an adapter connected to the power supply of the guitar, or an external power supply.

4. The system (100) of claim 1, wherein the display memory (158) comprises flash memory, random access memory (RAM), read-only memory (ROM), electrically erasable programmable read-only memory (EEPROM), or a combination thereof.

5. The system (100) of claim 1, wherein the first control button (120*a*) is disposed on the front surface (201).

6. The system (100) of claim 1, wherein the first control button (120*a*) is disposed on the side surface (203).

7. The system (100) of claim 1, wherein the connector component (130) is a universal serial bus (USB) port.

8. The system (100) of claim 1 further comprising a second control button (120*b*) operatively connected to the display processor, wherein the second control button is configured to send a third electronic signal to the display processor that changes the image displayed on the electronic ink display.

9. The system (100) of claim 1 further comprising a microphone system (170) disposed on the guitar body (200).

10. The system (100) of claim 9, wherein the microphone system (170) is operatively connected to the display microprocessor (150), wherein the display memory is further configured to store computer-readable instructions that, when executed by the display processor, cause the display processor to perform operations comprising:

a. receiving a fourth electronic signal from the microphone system (170);

b. processing the fourth electronic signal to determine a note;

c. retrieving an image from the display memory corresponding to the note; and d. generating a third plurality of signals at each electrical input of the connector of the electronic ink display, wherein the third plurality of signals comprises the image.

11. The system of claim 1 further comprising a wireless transceiver operatively connected to the display processor, wherein the wireless transceiver is configured to receive a fifth electronic signal from a wireless device, wherein the wireless transceiver is configured to send a sixth electronic signal to the display processor, wherein upon receiving the sixth electronic signal, the display processor is configured to load a new image from the display memory and display the new image on the electronic ink display.

12. The system of claim 1, wherein the signals are configured to specify a specific image.

* * * * *